US011293204B2

(12) United States Patent
Acunal et al.

(10) Patent No.: US 11,293,204 B2
(45) Date of Patent: Apr. 5, 2022

(54) DOOR HANDLE INCLUDING DUAL HINGED SOUND DAMPENING FLAP FEATURE

(71) Applicant: Illinois Tool Works Inc., Glenview, IL (US)

(72) Inventors: Mehmet Acunal, Schereville, IN (US); Walter Belchine, III, Plainfield, IL (US); Justin L. Ruzich, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 1028 days.

(21) Appl. No.: 15/768,109

(22) PCT Filed: Sep. 6, 2016

(86) PCT No.: PCT/US2016/050365

§ 371 (c)(1),
(2) Date: Apr. 13, 2018

(87) PCT Pub. No.: WO2017/069858

PCT Pub. Date: Apr. 27, 2017

(65) Prior Publication Data

US 2018/0298648 A1 Oct. 18, 2018

Related U.S. Application Data

(60) Provisional application No. 62/243,361, filed on Oct. 19, 2015.

(51) Int. Cl.
*E05B 15/16* (2006.01)
*E05B 77/36* (2014.01)
(Continued)

(52) U.S. Cl.
CPC ..... *E05B 77/36* (2013.01); *E05B 15/1635* (2013.01); *E05B 85/10* (2013.01); *E05B 2015/0465* (2013.01)

(58) Field of Classification Search
CPC ..... E05B 77/36; E05B 15/1635; E05B 85/10; E05B 2015/0465
See application file for complete search history.

(56) References Cited

U.S. PATENT DOCUMENTS 4,061,373 A * 12/1977 Revell ..... E05C 5/04 292/251
5,340,174 A * 8/1994 Bender ..... E05B 79/06 292/336.3
(Continued)

FOREIGN PATENT DOCUMENTS

CN 2297589 Y 11/1998
CN 102165242 A 8/2011
(Continued)

OTHER PUBLICATIONS

International Search Report and Written Opinion for PCT/US2016/050365.
(Continued)

*Primary Examiner* — Christine M Mills
*Assistant Examiner* — Thomas L Neubauer
(74) *Attorney, Agent, or Firm* — Quarles & Brady LLP

(57) ABSTRACT

An improved door handle assembly (10) having an integral sound dampening flap feature. The integral sound dampening flap feature incorporates an integrated dual hinged flap (52). This dual hinged flap (52) dampens vibration while adjusting to vertical movement and eliminating the need for any pivot pin or other retaining component.

20 Claims, 2 Drawing Sheets

(51) Int. Cl.
*E05B 85/10* (2014.01)
*E05B 15/04* (2006.01)

(56) References Cited

U.S. PATENT DOCUMENTS 5,499,851 A * 3/1996 Mitchell ..... E05B 79/06
292/337
5,713,705 A * 2/1998 Grunbichler ..... F16B 31/021
411/5
6,039,366 A * 3/2000 Lewis ..... E05B 79/06
292/352

FOREIGN PATENT DOCUMENTS

| | | | |
|---|---|---|---|
| CN | 102223847 | A | 10/2011 |
| CN | 102575744 | A | 7/2012 |
| CN | 202658991 | U | 1/2013 |
| DE | 70 24 450 | | 9/1970 |
| JP | 1966015997 | Y | 7/1966 |
| JP | 1987018825 | U | 2/1987 |
| JP | H07317403 | A | 12/1995 |
| JP | 1999224564 | A | 8/1999 |
| JP | 2014037759 | A | 2/2014 |
| KR | 20130122126 | A | 11/2013 |
| WO | WO 99/46463 | | 9/1999 |

OTHER PUBLICATIONS

First Office Action from corresponding Japanese Patent Application No. 2018-520146, dated Jul. 27, 2020 (8 pages).

* cited by examiner

DOOR HANDLE INCLUDING DUAL HINGED SOUND DAMPENING FLAP FEATURE

CROSS-REFERENCE TO RELATED APPLICATION

This application is a National Phase of International Application No. PCT/US2016/050365, filed Sep. 6, 2016, which claims the benefit of, and priority from, U.S. provisional patent application No. 62/243,361 having a filing date of Oct. 19, 2015. The contents of both of such applications are hereby incorporated by reference in their entirety as if fully set forth herein.

TECHNICAL FIELD

The present disclosure relates generally to automobile door handle assemblies, and more particularly, the disclosure relates to a door handle assembly incorporating an integrated dual hinged sound dampening flap feature. The sound dampening flap of the present disclosure may be particularly useful in flush door handle assemblies. The sound dampening flap reduces noise when the handle is depressed.

BACKGROUND

In known flush vehicle door handles, there is typically a metal screw connected to an outer support plate that rests on a metal flap. The metal flap, in turn, rests on a spring. The tension from the spring acts to bias the handle to its resting condition. In this arrangement, the metal flap acts to reduce undesired noise which may be caused by metal to metal contact between the screw and the spring when the handle is depressed. In this prior construction, the sound dampening flap is typically integrated into the door handle assembly using a three-piece arrangement made up of the spring housing, a retaining pivot pin and the flap.

While prior door handles incorporating such a three-piece sound dampening arrangement may be highly functional, the construction of such structures may be relatively complex and require substantial skill. Specifically, such structures may require multiple tools to produce the individual components and a labor-intensive assembly procedure must be used to join the small pieces into the three-piece construction. Accordingly, a sound dampening system which reduces complexity and labor while maintaining functionality would provide a useful advantage over the prior art.

SUMMARY

The present disclosure provides advantages and alternatives over the prior art by providing an improved sound dampening flap feature incorporated integrally within flush door handles. The improved sound dampening flap feature incorporates an integrated dual hinged flap. This dual hinge flap eliminates the need for any pivot pin or other retaining component thereby substantially simplifying the construction.

In accordance with one exemplary feature, the present disclosure provides a vehicle door handle assembly including a support plate disposed in overlying relation to a biasing spring. The support plate includes an exterior face projecting away from the biasing spring and a back face projecting towards the biasing spring. A transverse passageway extends across a thickness dimension of the support plate between the exterior face and the back face. A male member such as a fastener, rod, or the like is disposed in inserted relation within the transverse passageway. The male member comprises a proximal base disposed between the biasing spring and the back face. A spring housing supports the biasing spring and includes a perimeter wall that at least partially surrounds the biasing spring. A dual hinged flap is integral with the spring housing. The dual hinged flap includes an upper surface facing towards the support plate and a lower surface facing away from the support plate. The dual hinged flap includes a first hinge disposed adjacent the perimeter wall and a second hinge spaced radially inward from the first hinge. The dual hinged flap further includes a distal tab portion spaced apart from the perimeter wall such that the first hinge and the second hinge are disposed between the distal tab portion and the perimeter wall and wherein the distal tab portion is disposed in sandwiched relation between the biasing spring and the proximal base of the male fastener.

Other features and advantages of the disclosure will become apparent to those of skill in the art upon review of the following detailed description, claims and drawings.

While exemplary features of the disclosure are illustrated and will hereinafter be described in connection with certain potentially preferred embodiments and practices, it is to be understood that in no event is the disclosure limited to such illustrated and described embodiments and practices. On the contrary, it is intended that the present disclosure shall extend to all alternatives and modifications as may embrace the general principles of this disclosure within the full and true spirit and scope thereof.

Figure 1:
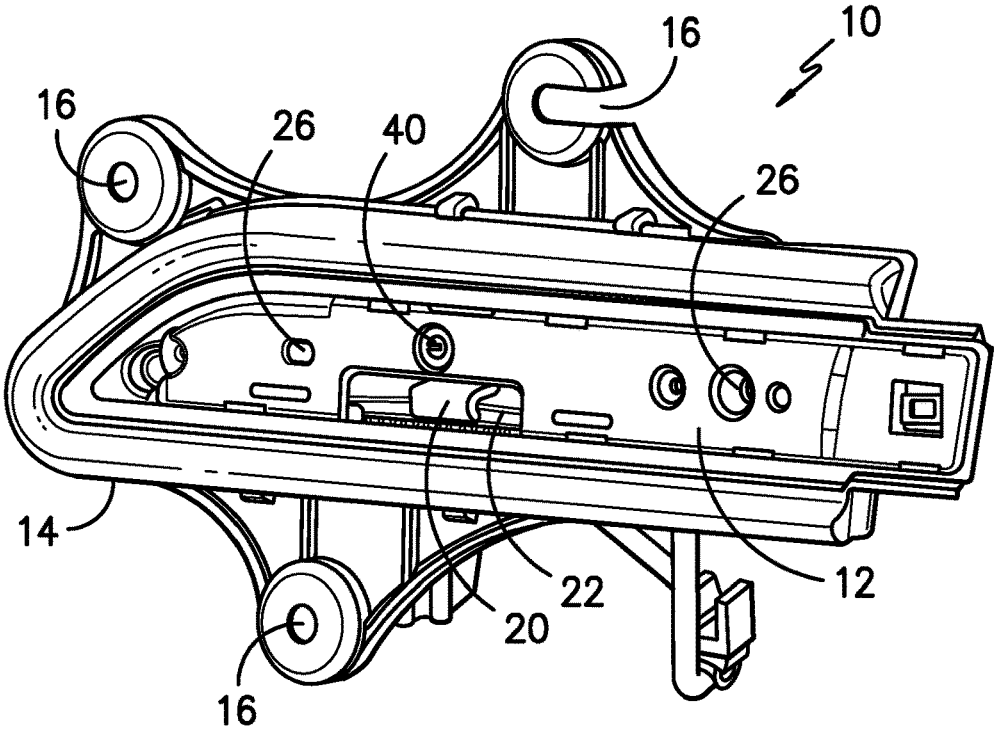
FIG. 1 is a schematic perspective view of an exemplary door handle assembly without a cover illustrating an outer support plate mounted within a surrounding mating component.

Before an embodiment of the disclosure is explained in detail, it is to be understood that the disclosure is not limited in its application to the details of construction and the arrangements of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF PREFERRED EMBODIMENT(S)

Exemplary features of the present disclosure will now be described through reference to the various figures, wherein to the extent possible like elements are designated by like reference numerals in the various views. Referring now to the drawings, FIG. 1 is a view of an exemplary door handle assembly 10 without a cover so as to illustrate various internal components. As shown, the door handle assembly 10 incorporates an outer support plate 12 housed at the interior of a surrounding mating component 14. As will be appreciated, the mating component 14 includes an arrangement of perimeter attachment openings 16 adapted to receive male connectors such as pins, male fasteners or the like (not shown) for connection to a backing structure in a manner as will be well known to those of skill in the art.

In the illustrated exemplary construction, the outer support plate 12 is substantially planar and provides a protective structural support covering for internal components of the door handle assembly 10 including a hooking latch 20 and complementary wire 22 which operate in a well-known manner during operation of the door handle assembly 10. In this regard, during operation of the door handle assembly 10, the hooking latch 20 may be caused to engage and lift the wire 22 during an opening procedure. Of course, other constructions may likewise be used if desired.

In the illustrated exemplary construction, the outer support plate 12 includes an exterior face 24 with a plurality of cutouts 26 disposed therein for access to the underlying operative components of the door handle assembly 10. By way of example only, and not limitation, the outer support plate may be formed as a unitary structure from a suitable plastic material such as acetal resin, Nylon 6, polyester or the like using techniques such as injection molding and the like. However, it is also contemplated that other structural materials such as metals, composites, and the like may likewise be utilized if desired.

Figure 2:
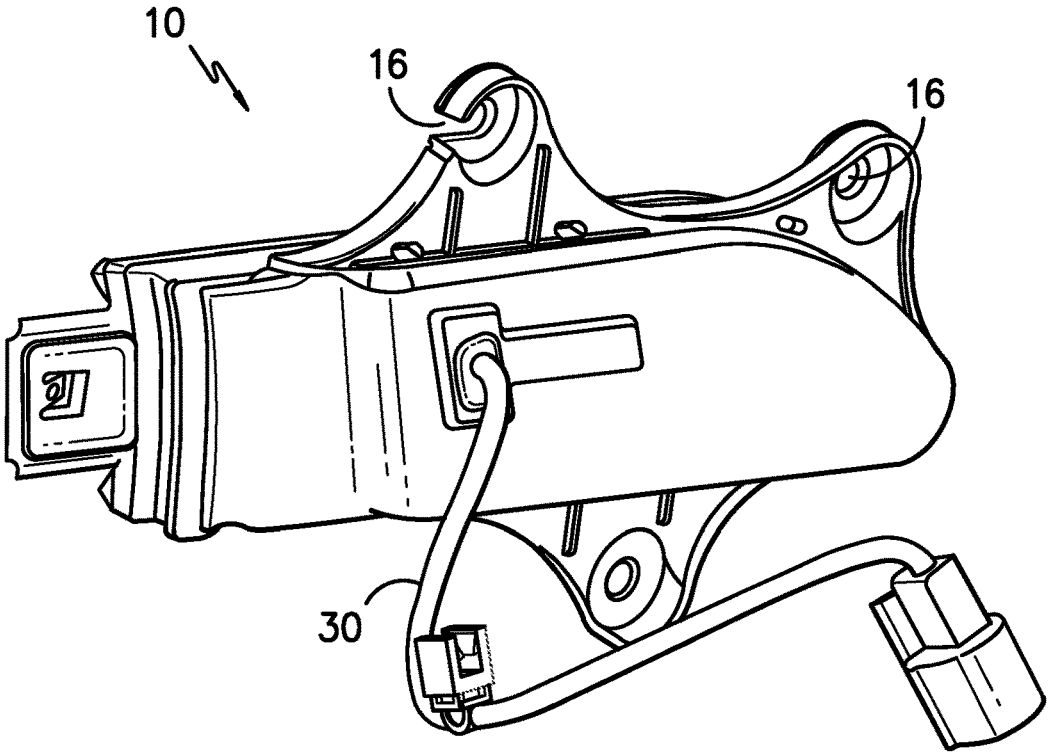
FIG. 2 is a schematic perspective view of the reverse side of the exemplary door handle assembly of FIG. 1 illustrating the activating lever used during operation of the door handle assembly.

As illustrated in the rear view of FIG. 2, a linkage arm 30 may be used to operatively engage the hooking latch 20 during operation so as to permit the door handle assembly 10 to open when a pivoting force is applied by a user activating a door handle. Such an operation will be well known and understood by those of skill in the art.

Figure 3:
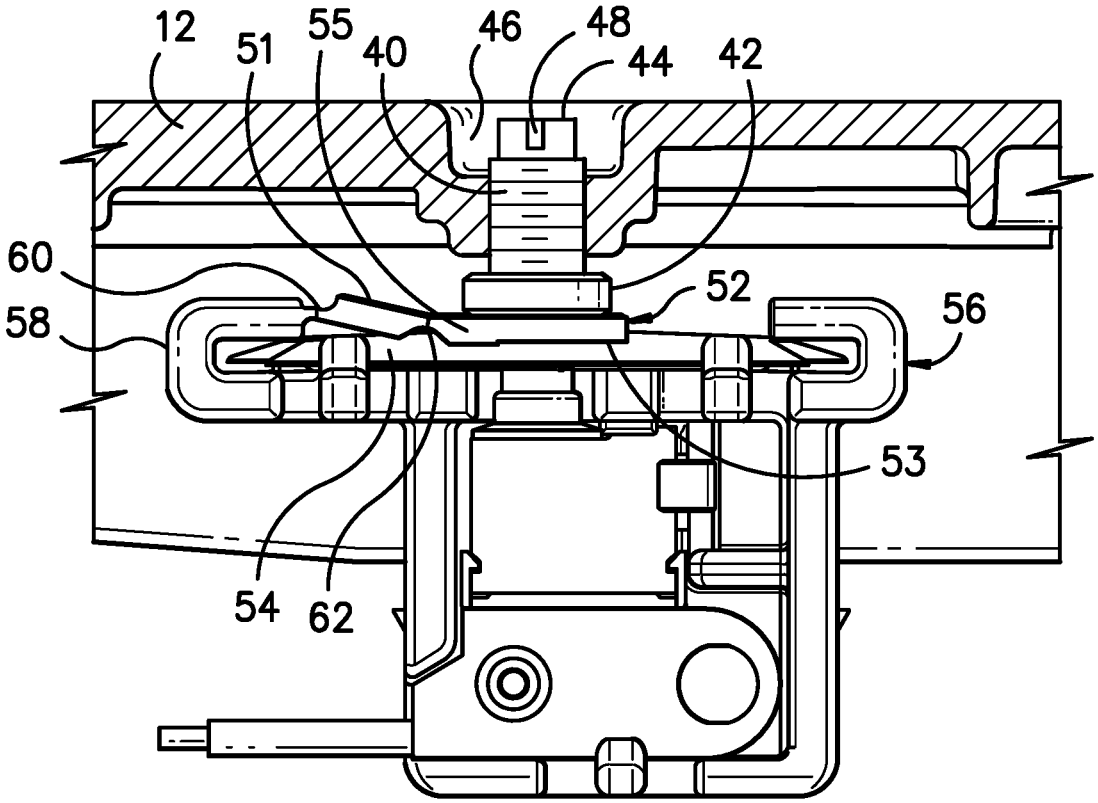
FIG. 3 is a schematic sectional view of the exemplary door handle assembly of FIG. 1 incorporating an exemplary dual hinge flap feature consistent with the present disclosure.

In the illustrated exemplary construction, the outer support plate 12 includes a transverse passageway extending across the thickness dimension of the outer support plate 12. The transverse passageway defines a female opening for acceptance and retention of a male fastener 40 or other male member such as a pin or the like as best seen in FIG. 3. In the illustrated exemplary construction, the male fastener 40 may be adjusted from either end so as to establish s desired depth setting within the support plate. The male fastener 40 thus establishes and maintains a proper depth setting for the outer support plate 12 relative to the surrounding mating component 14. Such a proper depth setting facilitates proper function while avoiding damage that may result from excessive compression.

By way of example only and not limitation, in the illustrated exemplary construction the male fastener 40 may include a proximal base 42 positioned at the interior of the door handle assembly 10 and a distal end 44 disposed at the exterior of the outer support plate 12 (FIG. 3). As best seen through joint reference to FIGS. 1 and 3, the distal end 44 may be disposed at the interior of a surface well 46 at the exterior of the outer support plate 12. A tool engagement slot or pattern 48 may be located at the distal end 44 for engagement with a screwdriver or other adjustment tool. A tool engagement slot or pattern (not shown) also may be located at the proximal base 42 if desired such that the depth of the male fastener 40 may be adjusted from either end. In this regard, while the male fastener 40 is illustrated as a threaded fastener, any other suitable adjustable structure may likewise be used to establish and maintain proper depth as desired.

Referring to FIG. 3, in the exemplary construction, the proximal base 42 of the male fastener 40 is positioned in overlying opposing relation to a dual hinged flap 52. As illustrated, the dual hinged flap 52 includes an upper surface 51 facing generally towards the support plate 12 and a lower surface 53 facing generally away from the support plate. The dual hinged flap 52 is disposed in overlying relation to a dome spring 54 of metal or the like which continuously urges a distal tab portion 55 of the dual hinged flap 52 upwardly towards the support plate 12 and against the male fastener 40.

As illustrated, in the exemplary construction, the dome spring 54 may be supported within a spring housing 56 of generally annular construction having a perimeter wall 58 which at least partially surrounds the outer edge of the dome spring 54. In this regard, the outer edge of the dome spring 54 may be held within a circumferential retaining groove at the interior of the perimeter wall 58. As shown, the inner diameter of the retaining slot may be slightly greater than the outer diameter of the done spring 54 while nonetheless substantially constraining the dome spring 54 against radial or vertical displacement.

In operation, the dual hinged flap 52 operates to substantially suppress vibration-induced sound which may otherwise result from the interaction between the male fastener 40 and the dome spring 54 during operation. In accordance with one exemplary practice, the dual hinged flap 52 may be formed integrally with the spring housing 56 as a unitary structure by techniques such as injection molding or the like such that the spring housing 56 and the dual hinged flap 52 cooperatively form a unitary construction made from a single material. Materials of construction for the spring housing 56 and the dual hinged flap 52 preferably include polymeric materials such as acetal resin, Nylon, polyester, and the like having suitable pliability and toughness to incorporate living hinges without failure. However, other constructions and materials may likewise be used if desired. In particular, it is contemplated that different materials may be used to form the spring housing 56 and the dual hinged flap 52 if desired. By way of example only, and not limitation, such a construction incorporating different materials may be formed using techniques such as multi-shot molding or the like.

In the illustrated exemplary construction, the dual hinged flap 52 incorporates a pair of molded-in living hinges disposed between the perimeter wall 58 and the distal tab portion 55. In this regard, in the illustrated exemplary construction, a first hinge 60 is located at a proximal position adjacent the perimeter wall 58 substantially at the intersection of the dual hinged flap 52 with the spring housing 56. In this embodiment, a second hinge 62 is positioned radially inboard from the first hinge. As shown, in the exemplary construction, the first hinge 60 establishes an operative bending connection between the dual hinged flap 52 and the spring housing 56. The second hinge 62 facilitates parallel vertical movement of the distal tab portion 53 when the handle is depressed such that the distal tab portion may move up and down while retaining a substantially planar orientation between the male fastener 40 and the dome spring 54 during operation.

As noted previously, in the illustrated exemplary construction, the first hinge 60 and the second hinge 62 may be molded-in living hinges arranged on opposite sides of the dual hinged flap 52. As shown, in the exemplary construction, the first hinge 60 may be defined by a scalloped depression on the upper face 51 and the second hinge 62 may be defined by a scalloped depression on the lower face 53. However, it is likewise contemplated that the first hinge 60 and the second hinge 62 may be arranged on the same side of the flap 52 if desired. In this regard, it will be understood that the term "living hinge" refers to a hinge which operates by controlled bending of a structure rather than by the use of additional mechanical hinge structures. While such structures may be formed using the illustrated scalloped surface depressions, it is likewise contemplated that suitable living hinges formed by introducing angled notches, slits, or reduced thicknesses may likewise be used if desired In operation, when the handle is opened, the male fastener 40 will apply a downward compressing force against the dome spring 54. In this condition, the dome spring will apply an opposing recovery force against the male fastener 40 thereby urging the handle to the resting, closed position. During this operation, the dual hinged flap 52 acts to reduce undesired vibration noise as the handle is depressed. Unlike prior constructions, no pivot pin or other mechanical retaining device is required to operate the dual hinged flap 52. Rather, the dual hinged flap 52 makes use of an integral connection to the spring housing 56 and a pair of bending living hinges 60, 62.

As the male fastener moves downward, the distal tab portion 55 of the dual hinged flap 52 may remain in substantially planar engagement against the dome spring 54 while moving vertically as the living hinges 60, 62 undergo bending to accommodate such vertical movement. In this regard, as the distal tab portion 55 moves vertically downward, the second hinge 62 may be caused to open up while the dual hinged flap 52 flexes at the first hinge 60 to accommodate this opening. Likewise, as the distal tab portion 55 moves vertically upward, the second hinge 62 may be caused to close, while the dual hinged flap 52 flexes at the first hinge 60 to accommodate such closing. Such adjustments may take place substantially continuously during use to adjust to vibration induced vertical movements. Surprisingly, it has been found that such a structure maintains integrity over an extended period of use despite the high level of cyclical bending. Moreover, the dual hinged flap may retain its desired orientation even in the presence of significant vertical movement of the overlying and underlying structures. Thus, the dual hinged flap is suitable to dampen vibration over a wide range of operating conditions.

Of course, variations and modifications of the foregoing are within the scope of the present disclosure. The use of the terms "a" and "an" and "the" and similar referents in the context of describing the invention (especially in the context of the following claims) are to be construed to cover both the singular and the plural, unless otherwise indicated herein or clearly contradicted by context.

The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A vehicle door handle assembly comprising:

a support plate disposed in overlying relation to a biasing spring, the support plate comprising an exterior face projecting away from the biasing spring and a back face projecting towards the biasing spring, wherein a transverse passageway extends across a thickness dimension of the support plate between the exterior face and the back face; and a male member disposed in inserted relation within the transverse passageway, wherein the male member comprises a proximal base disposed between the biasing spring and the back face;

a spring housing supporting the biasing spring, wherein the spring housing includes a perimeter wall at least partially surrounding the biasing spring; and a dual hinged flap integral with the spring housing, the dual hinged flap having an upper surface facing towards the support plate and a lower surface facing away from the support plate, the dual hinged flap including a first hinge disposed adjacent the perimeter wall and a second hinge spaced apart from the first hinge, the dual hinged flap further including a distal tab portion spaced apart from the perimeter wall such that the first hinge and the second hinge are disposed between the distal tab portion and the perimeter wall and wherein the distal tab portion is disposed in sandwiched relation between the biasing spring and the proximal base of the male member.

2. The vehicle door handle assembly as recited in claim 1, wherein the biasing spring is a dome spring.

3. The vehicle door handle assembly as recited in claim 2, wherein the perimeter wall substantially surrounds the biasing spring.

4. The vehicle door handle assembly as recited in claim 1, wherein the spring housing and the dual hinged flap are each of polymeric molded construction.

5. The vehicle door handle assembly as recited in claim 4, wherein the spring housing and the dual hinged flap are integrally molded from the same polymeric material.

6. The vehicle door handle assembly as recited in claim 5, wherein said same polymeric material is selected from the group consisting of acetal resin, Nylon and polyester.

7. The vehicle door handle assembly as recited in claim 4, wherein the first hinge is a living hinge.

8. The vehicle door handle assembly as recited in claim 4, wherein the second hinge is a living hinge.

9. The vehicle door handle assembly as recited in claim 4, wherein the first hinge is a living hinge and the second hinge is a living hinge.

10. The vehicle door handle assembly as recited in claim 9, wherein the first hinge comprises a depression on the upper surface and the second hinge comprises a depression on the lower surface.

11. A vehicle door handle assembly comprising:

a support plate disposed in overlying relation to a biasing dome spring, the support plate comprising an exterior face projecting away from the biasing dome spring and a back face projecting towards the biasing dome spring, wherein a transverse passageway extends across a thickness dimension of the support plate between the exterior face and the back face, wherein the biasing spring is a dome spring; and a male member disposed in inserted relation within the transverse passageway, wherein the male member comprises a proximal base disposed between the biasing dome spring and the back face, the male member further comprising a distal end projecting outwardly from the exterior face;

a spring housing supporting the biasing dome spring, wherein the spring housing includes a perimeter wall at least partially surrounding the biasing spring; and a dual hinged flap integral with the spring housing, the dual hinged flap having an upper surface facing towards the support plate and a lower surface facing away from the support plate, the dual hinge flap including a first living hinge at a position adjacent the perimeter wall and a second living hinge spaced apart from the first hinge, the dual hinged flap further including a distal tab portion spaced apart from the perimeter wall such that the first hinge and the second hinge are disposed between the distal tab portion and the perimeter wall and wherein the distal tab portion is disposed in sandwiched relation between the biasing spring and the proximal base of the male member.

12. The vehicle door handle assembly as recited in claim 11, wherein the perimeter wall substantially surrounds the biasing spring.

13. The vehicle door handle assembly as recited in claim 11, wherein the spring housing and the dual hinged flap are each of polymeric molded construction.

14. The vehicle door handle assembly as recited in claim 13, wherein the spring housing and the dual hinged flap are integrally molded from the same polymeric material.

15. The vehicle door handle assembly as recited in claim 14, wherein said same polymeric material is selected from the group consisting of acetal resin, Nylon and polyester.

16. The vehicle door handle assembly as recited in claim 14, wherein the first hinge is a living hinge comprising a scalloped depression on the upper surface.

17. The vehicle door handle assembly as recited in claim 14, wherein the second hinge is a living hinge comprising a scalloped depression on the lower surface.

18. The vehicle door handle assembly as recited in claim 14, wherein the first hinge is a living hinge comprising a scalloped depression on the upper surface and wherein the second hinge is a living hinge comprising a scalloped depression on the lower surface.

19. A vehicle door handle assembly comprising:

a support plate disposed in overlying relation to a biasing dome spring, the support plate comprising an exterior face projecting away from the biasing dome spring and a back face projecting towards the biasing dome spring, wherein a transverse passageway extends across a thickness dimension of the support plate between the exterior face and the back face, wherein the biasing spring is a dome spring; and a male member disposed in inserted relation within the transverse passageway, wherein the male member comprises a proximal base disposed between the biasing dome spring and the back face, the male member further comprising a distal end projecting outwardly from the exterior face;

a spring housing supporting the biasing dome spring, wherein the spring housing includes a perimeter wall at least partially surrounding the biasing spring; and a dual hinged flap integral with the spring housing, the dual hinged flap having an upper surface facing towards the support plate and a lower surface facing away from the support plate, the dual hinge flap including a first living hinge comprising a scalloped depression on the upper surface at a position adjacent the perimeter wall and a second living hinge comprising a scalloped depression on the lower surface spaced apart from the first hinge, the dual hinged flap further including a distal tab portion spaced apart from the perimeter wall such that the first hinge and the second hinge are disposed between the distal tab portion and the perimeter wall and wherein the distal tab portion is disposed in sandwiched relation between the biasing spring and the proximal base of the male member, wherein the spring housing and the dual hinged flap are integrally molded from the same polymeric material.

20. The vehicle door handle assembly as recited in claim 19, wherein wherein said same polymeric material is selected from the group consisting of acetal resin, Nylon and polyester.

* * * * *